US005511395A

United States Patent [19]

Hamade et al.

[11] Patent Number: 5,511,395

[45] Date of Patent: Apr. 30, 1996

[54] CARBON FIBER FABRIC SPREADING APPARATUS HAVING A FREELY ROTATABLE ENDLESS BELT

[75] Inventors: Saburo Hamade; Masahiko Takahiro, both of Ishikawa; Kazuo Morohashi, Kanagawa, all of Japan

[73] Assignees: Ishikawa Prefecture; Nippon Oil Company, Ltd., both of Japan

[21] Appl. No.: 340,657

[22] Filed: Nov. 16, 1994

[30] Foreign Application Priority Data

Nov. 22, 1993 [JP] Japan ..... 5-316023

[51] Int. Cl.[6] ..... D06B 13/00

[52] U.S. Cl. ..... 68/2; 68/355

[58] Field of Search ..... 68/2, 355; 118/57; 28/167, 168, 182, 183, 283; 26/18.5

[56] References Cited

U.S. PATENT DOCUMENTS 3,292,397 12/1966 Wooliever ..... 68/3 SS X 3,712,085 1/1973 Guberman et al. ..... 68/3 SS

*Primary Examiner*—Philip R. Coe

*Attorney, Agent, or Firm*—Dominik & Stein

[57] ABSTRACT

A freely rotatable endless belt has a bottom face that is opposed, in the water, to an ultrasonic oscillator. A carbon fiber fabric is transferred from a supply roller to a hot roller while being given tension by means of a torque motor and a constant speed motor connected to the supply roller and the hot roller, respectively. The carbon fiber fabric moves in contact with the bottom face of the endless belt, whereby endless belt rotates in synchronism with the carbon fiber fabric. Two oblique movement correcting belts are so disposed as to be pressed against both side portions of the endless belt while gripping respective selvages of the carbon fiber fabric. Each of the two oblique movement correcting belts is connected to a variable speed motor via a unidirectional clutch that transmits a driving force only in the direction of transferring the carbon fiber fabric.

10 Claims, 3 Drawing Sheets

CARBON FIBER FABRIC SPREADING APPARATUS HAVING A FREELY ROTATABLE ENDLESS BELT

BACKGROUND OF THE INVENTION

The present invention relates to an apparatus for spreading a carbon fiber fabric woven from multifilament yarn, that is, an apparatus which, by use of ultrasonic waves, separates carbon filaments from each other that are bonded together with a sizing agent and then spreads the separated filaments.

U.S. Pat. No. 5,016,451 (corresponds to Japanese Examined Patent Publication No. Hei. 4-70420) discloses an apparatus for spreading warps and wefts of a carbon fiber fabric woven with multifilament yarn by applying ultrasonic waves to the fabric in water. As shown in FIG. 3, this conventional apparatus includes a water vessel 2, an ultrasonic oscillator 3 immersed in the water contained in the water vessel 2, a glass guide plate 21 that is opposed to the ultrasonic oscillator 3 in the water, a transfer belt 22 for continuously transferring a carbon fiber fabric 20*b* along a face 21*a* of the guide plate 21 which face is opposed to the ultrasonic oscillator 3, and a drying device 23 for drying a carbon fiber fabric 20*c* that has been output from the belt 22. Feeding speeds of a supply roller 1 and the transfer belt 22 are equalized by an electric circuit incorporated in an electric control box 24, so that no tension is exerted on carbon fiber fabrics 20*a* and 20*b* between the roller 1 and the belt 22. This is to protect the carbon fiber fabric, which is likely damaged by a bending force, from strong bending forces as would be applied by a front edge 21*b* and a rear edge 21*c* of the guide plate 21 to the carbon fiber fabric when it received tension. Further, a feeding speed of the transfer belt 22 and a rolling speed of a take-up roller 7 that is disposed downstream of the drying device 23 are also controlled by the electric control box 24 so that no tension is exerted on carbon fiber fabrics 20*c* and 20*d* that are subjected to drying. In this manner, in the conventional apparatus, no tension is applied to the carbon fiber fabrics 20*a*–20*d* from the paying out to the rolling up.

In the above conventional apparatus, since the carbon fiber fabric 20*b* is transferred while being pressed against the fixed guide plate 21, a frictional force occurring between the fabric 20*b* and the guide plate 21 may delay a central portion of a weft to thereby curve it. Further, because the carbon fiber fabric 20*c* should be kept in a non-tension state to prevent it from receiving strong, localized bending forces from the edges of the guide plate 21, the introduction and exit portions of the apparatus adjacent to the guide plate 21 need to be sufficiently long, which necessarily increases the size of the spreading water vessel 2. Further, since the spread fabric 20*c* is in a non-tension state, surface tension of water may re-bond filaments together (hereinafter referred to as "reintegration"). Still further, a variation in the thickness of right and left selvages and other factors may cause an error in the feeding speed of the selvages, and when accumulated, this error may cause slanted transfer of the carbon fiber fabric 20*a*.

SUMMARY OF THE INVENTION

The present invention has been made to solve the above problems. Therefore, an object of the invention is to provide a small-sized spreading apparatus which can produce a sufficiently spread carbon fiber fabric while preventing reintegration of filaments, curving of wefts and slanted transfer of a fabric.

According to the invention, a spreading apparatus comprises a water vessel containing water; an ultrasonic oscillator immersed in the water; transfer means for continuously transferring the carbon fiber fabric; and an endless belt having a bottom face that is immersed in the water so as to be opposed to the ultrasonic oscillator and is in contact with the carbon fiber fabric being transferred, the endless belt rotating in synchronism with the carbon fiber fabric.

The following constitution is preferred. The endless belt is so supported as to be freely rotatable, and the carbon fiber fabric is transferred while tension is applied to the carbon fiber fabric by means of load applying means for applying a load to the carbon fiber fabric and the transfer means disposed upstream of and downstream of the endless belt, respectively. The transfer means includes drying means for drying the carbon fiber fabric. The load applying means includes a torque motor for applying a reverse rotational force to a supply roller on which the carbon fiber fabric is wound. Two oblique movement correcting belts are so disposed as to be pressed against both side portions of the endless belt while gripping respective selvages of the carbon fiber fabric, each of the two oblique movement correcting belts being connected to a variable speed motor via a uni-directional clutch that transmits a driving force only in the direction of transferring the carbon fiber fabric.

The carbon fiber fabric to be spread moves together with the endless belt above the ultrasonic oscillator. Receiving ultrasonic waves, i.e., acoustic pressure, the carbon fiber fabric is pressed against the bottom face of the endless belt and thereby flattened. In this state, ultrasonic waves act on multifilament yarns and the yarns are spread.

Since ultrasonic waves are applied to the carbon fiber fabric that is flattened in the water and backed up by the endless belt, they act on the fabric surface uniformly and efficiently. Since the carbon fiber fabric moves together with the endless belt, wefts are not curved. Further, since the front and rear end portions of the endless belt are gently curved, the carbon fiber fabric can be transferred without being bent abruptly. Since the fabric transfer direction immediately before and after the endless belt can be inclined to a large extent, the introduction and exit portions adjacent to the endless belt can be shortened to enable size reduction of the water vessel. Further, it becomes possible to transfer the carbon fiber fabric while applying tension thereto.

Since certain tension is always be applied to the spread fabric until completion of the drying, there can be prevented reintegration of the fabric due to surface tension of water. Further, the correcting means including the two oblique movement correcting belts corrects oblique movement of the fabric by adjusting moving speeds of its selvages.

DESCRIPTION OF THE PREFERRED EMBODIMENT

Figure 1:
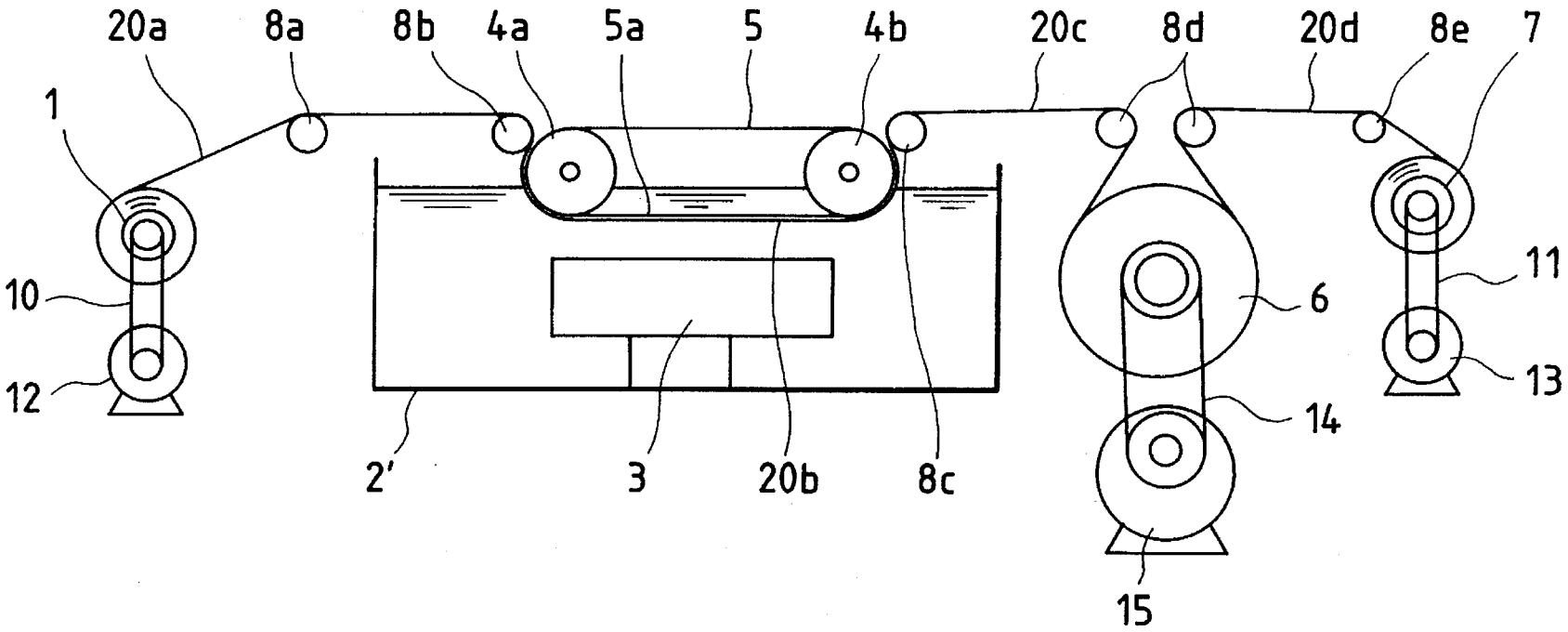
FIG. 1 is a schematic side view showing a spreading apparatus according to an embodiment of the present invention.

FIG. 1 schematically shows a spreading apparatus according to an embodiment of the present invention. Reference symbol 1 denotes a supply roller for supplying a carbon fiber fabric 20*a*; 2', a spreading water vessel; 3, an ultrasonic oscillator immersed in the water vessel 2'; 4*a* and 4*b*, freely rotatable support rollers that are located above the ultrasonic oscillator 3 and spaced from each other; 5, an endless steel belt wound on the support rollers 4*a* and 4*b*; 6, a hot roller for drying a spread carbon fiber fabric 20*c*; 7, a take-up roller for taking up a dried fabric 20*d*; 8*a*–8*e*, guide rollers for guiding a fabric 20*a* payed out from the supply roller 1 to the take-up roller 7 via the steel belt 5 and the hot roller 6.

Since the front and rear end portions of the steel belt 5 are gently curved being wound on the support rollers 4*a* and 4*b*, the transfer path assumes a curved surface in these portions. Therefore, the carbon fiber fabric can be transferred without being bent abruptly. Since the fabric transfer direction immediately before and after the steel belt 5 can be inclined to a large extent, the introduction and exit portions adjacent to the steel belt 5 can be shortened to enable size reduction of the water vessel 2'. Further, it becomes possible to transfer the carbon fiber fabric while applying tension thereto.

The supply roller 1 and the take-up roller 7 are connected to torque motors 12 and 13 via belts 10 and 11, respectively. The torque motor 12 gives the supply roller 1 a weak load in the direction (tension applying direction) opposite to the paying-out direction of the fabric 20*a*. The torque motor 13 gives the take-up roller 7 a forward torque to roll up the fabric 20*d* as output from the hot roller 6 while applying weak tension thereto. The hot roller 6 is connected to a constant-speed motor 15 via a belt 14. The motor 15 rotates the hot roller 6 at a constant speed, to thereby transfer the fabric 20*c*. Therefore, the fabric (represented by symbols 20*a*, 20*b* and 20*c*) payed out from the supply roller 1 is transferred while being given certain tension by means of the hot roller 6 and the torque motor 12. The tension causes the fabric to move along the steel belt 5, to thereby rotate the steel belt 5 together with the fabric.

Since the spread fabric 20*c* is transferred to the hot roller 6 and dried therein while receiving tension, there is no possibility of being reintegrated. Since tension is always applied to the carbon fiber fabric, the fabric can be managed easily in the spreading process. Further, even wide fabrics and fabrics having a coarse weaving structure can be spread uniformly.

Figure 2:
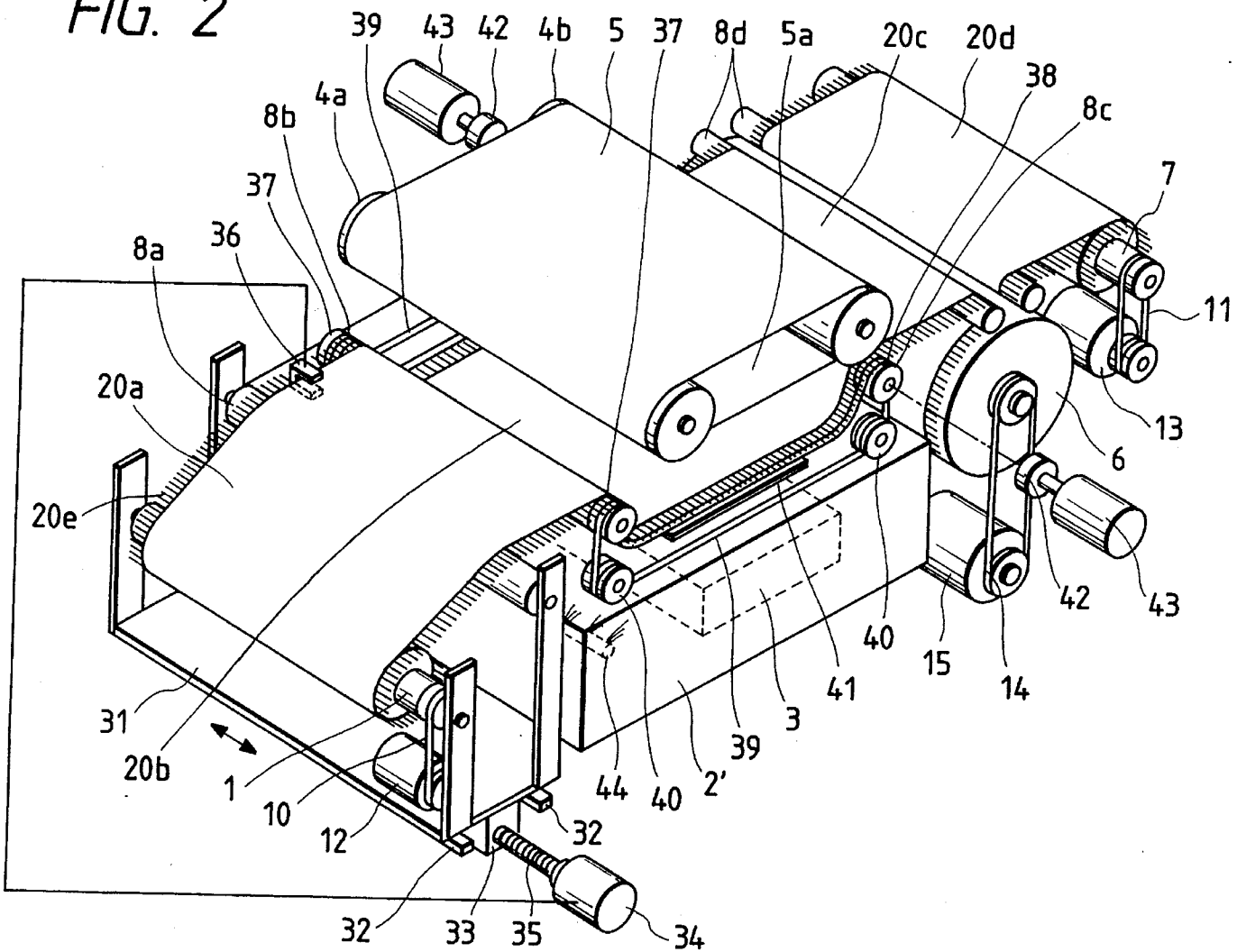
FIG. 2 is a detailed perspective view of the spreading apparatus of FIG. 1.
Figure 3:
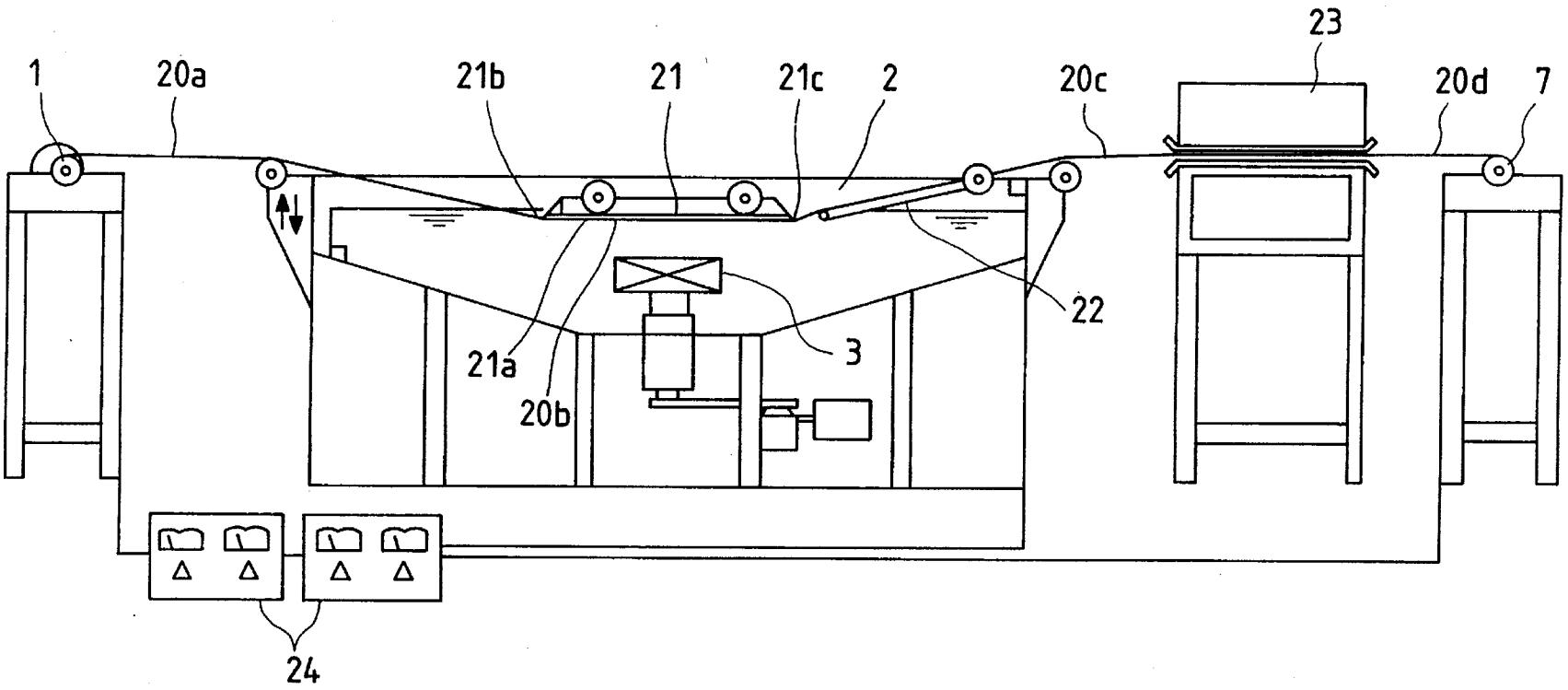
FIG. 3 PRIOR ART
FIG. 3 is a schematic side view of a conventional spreading apparatus.

FIG. 2 is a detailed perspective view of the spreading apparatus of the embodiment. The supply roller 1 and the guide roller 8*a* are held by a movable stage 31, which is slidably supported by rails 32 that extend in the width direction of the fabric 20*a*. A threaded rod 35 extending in parallel with the rails 32 engages a nut member 33 that is fixed to the bottom face of the movable stage 31, and is also connected to a position adjusting motor 34. The motor 34 is controlled based on an output of a sensor 36 that is located in front of the spreading water vessel 2'. More specifically, when the sensor 36 detects the side of the fabric 20*a*, the position adjusting motor 34 rotates normally or reversely to adjust the position of the movable stage 31 so that the center of the fabric always coincides with the center of the apparatus.

The guide rollers 8*b* and 8*c* are disposed before and after the steel belt 5 to guide the fabric 20*b* so that it moves along the steel belt 5. In FIG. 2, to show the members disposed below the steel belt 5, the steel belt 5 and its support rollers 4*a* and 4*b* are drawn above their actual positions.

Pulleys 37 are axially supported at both ends of the guide roller 8*b* in such a manner that the axes of the pulleys 37 and the guide roller 8*b* coincide with each other and that they can rotate with respect to each other. Pulleys 38 are supported at both ends of the guide roller 8*c* in the same manner. Rubber belts 39 for preventing slanted transfer of the fabric 20*b* are wound on the pulleys 37 and 38. Guide pulleys 40 guide the return portions of the rubber belts 39. The feeding-side portions (top portions) of the rubber belts 39 are backed up by a guide member 41, which has grooves for guiding the respective rubber belts 39 in a half-merged state.

The feeding-side portions of the rubber belts 39 are pressed against both side portions of the bottom face of the steel belt 5, and grip only selvages (end portions of wefts) 20*e* that project from warps on both sides of the carbon fiber fabric 20*b*, which moves together with the steel belt 5. A variable speed motor 43 is connected to each of the downstream pulley 38 via a uni-directional clutch 42 for transmitting a driving force only in the direction of feeding the fabric. The variable speed motors 43 are so driven that the pulleys 38 rotate in step with the steel belt 5. However, when the fabric is moving obliquely, one of the motors 43 is accelerated which is located on the side of a lagging portion of wefts. Thus, the slanted transfer is corrected.

A water jetting pipe 44, which is disposed upstream of the spreading water vessel 2', jets water to discharge bubbles generated by the ultrasonic oscillator 3 from under the steel belt 5. Thus, it is prevented that bubbles staying under the bottom surface 5*a* of the steel belt 5 reduce the spreading efficiency.

In consideration of the fact that the width of yarns increases when they are exposed to ultrasonic waves, the carbon fiber fabric is woven coarsely (about 3 yarns/cm in both longitudinal and transverse directions). Ultrasonic waves emitted from the ultrasonic oscillator 3 are reflected by the steel belt 5, so that standing waves are formed. Being exposed to the standing waves thus formed, the carbon fiber fabric 20*b* is spread. Since the bottom face 5*a* itself of the steel belt 5 is vibrated, the fabric 20*b* that is in close contact with the bottom face 5*a* is also mechanically vibrated. Thus, the spreading operation is facilitated.

The spread fabric 20*c* that has passed the bottom face 5*a* of the steel belt 5 is lifted out of the water vessel 2' at the guide roller 8*c*, and guided by the guide roller 8*d* so as to be wound on the hot roller 6, by which the fabric 20*c* is dried. In this embodiment, the motor 15, which gives a rotational force to the hot roller 6, controls the speed of the fabric 20*b* (i.e., the portion of the fabric which is exposed to ultrasonic waves) at a constant value. On the other hand, the motor 12 gives a reverse torque to the supply roller 1. The take-up roller 7 takes up the dried fabric 20*d* while applying a weak torque to it.

While the endless belt is made of steel in the above embodiment, it may be made of any flexible, waterproof material as long as it does not depart from the spirit of the invention. For example, the following materials can be used: tin-plated steel, aluminum and FRP (in particular, glass-fiber-reinforced Teflon (trademark)).

While in the above embodiment the carbon fiber fabric is dried by the hot roller, it may be dried by any means as long as it does not depart from the spirit of the invention. For example, there may be used a net conveyor driving type drying device.

As described above, according to the invention, since the endless belt, which serves as the back-up member for the ultrasonic-wave-receiving portion of the carbon fiber fabric, moves in synchronism with the fabric, wefts can be prevented from curving. By virtue of the use of the endless belt being wound on the support rollers, the transfer path does not have any portion where the fabric receives a strong, localized bending force, and it has become possible to shorten the introduction and exit portions of the spreading water vessel. Further, it has become possible to apply tension to the fabric.

Since the spreading operation is performed in such a state manner that certain tension is applied from the paying out to the drying, the fabric can be managed more easily in the spreading process. Further, even wide fabrics and fabrics having a coarse weaving structure can be spread properly. Since certain tension can always be applied to the spread fabric until completion of the drying, there can be prevented reintegration of the fabric due to surface tension of water. Further, if necessary, by providing the oblique movement correcting means, oblique movement of the fabric can be corrected while it is subjected to the spreading operation. This contributes to production of high-quality spread fabrics.

What is claimed is:

1. An apparatus for spreading a carbon fiber fabric, comprising:

a water vessel containing water;

an ultrasonic oscillator immersed in the water;

an endless belt having a bottom face that is immersed in the water so as to be opposed to the ultrasonic oscillator; and transfer means for continuously transferring carbon fiber fabric from a supply roller, past the bottom face of the endless belt, to a take-up roller;

wherein the bottom face of the endless belt is in contact with the carbon fiber fabric being transferred, and wherein the endless belt moves together with the carbon fiber fabric.

2. The apparatus of claim 1, wherein the endless belt is so supported as to be freely rotatable, and wherein the carbon fiber fabric is transferred while tension is applied to the carbon fiber fabric by means of the transfer means and a torque motor disposed upstream of the endless belt for applying a reverse rotational force to a supply roller on which the carbon fabric is wound.

3. The apparatus of claim 2, wherein the transfer means includes drying means for drying the carbon fiber fabric.

4. The apparatus of claim 3, wherein the drying means includes a hot roller on which the carbon fiber fabric is wound.

5. The apparatus of claim 4, wherein the transfer means includes a constant speed motor for rotating the hot roller at a constant speed.

6. The apparatus of claim 1, further comprising two oblique movement correcting belts so disposed as to be pressed against both side portions of the endless belt while gripping respective selvages of the carbon fiber fabric, each of the two oblique movement correcting belts being connected to a variable speed motor via a uni-directional clutch that transmits a driving force only in a direction of transferring the carbon fiber fabric.

7. The apparatus of claim 6, wherein when the carbon fiber fabric is moving obliquely, one of the variable speed motors which is located on the side of a lagging portion of the carbon fiber fabric is accelerated to correct the oblique movement.

8. The apparatus of claim 1, further comprising two freely rotatable support rollers on which the endless belt is wound.

9. The apparatus of claim 8, further comprising two guide rollers disposed adjacent to the endless belt, for introducing and receiving the carbon fiber fabric to and from the endless belt, respectively.

10. The apparatus of claim 1, wherein the endless belt is a metallic belt.

* * * * *